US009615722B2

(12) United States Patent
Mesa et al.

(10) Patent No.: US 9,615,722 B2
(45) Date of Patent: Apr. 11, 2017

(54) STEMWARE HOLDER UNIT, DISHWASHER CUP SHELF COMPRISING A STEMWARE HOLDER UNIT, AND A DISHWASHER BASKET ASSEMBLY COMPRISING A DISHWASHER CUP SHELF

(71) Applicant: ELECTROLUX HOME PRODUCTS CORPORATION N. V., Brussels (BE)

(72) Inventors: Daniel Mesa, Stockholm (SE); Adam Szczepanowski, Stockholm (SE)

(73) Assignee: Electrolux Home Products Corporation N.V., Brussels (BE)

( * ) Notice: Subject to any disclaimer, the term of this patent is extended or adjusted under 35 U.S.C. 154(b) by 0 days.

(21) Appl. No.: 14/654,980

(22) PCT Filed: Dec. 21, 2012

(86) PCT No.: PCT/EP2012/076769
§ 371 (c)(1),
(2) Date: Jun. 23, 2015

(87) PCT Pub. No.: WO2014/094898
PCT Pub. Date: Jun. 26, 2014

(65) Prior Publication Data
US 2016/0037997 A1 Feb. 11, 2016

(51) Int. Cl.
*A47L 15/50* (2006.01)

(52) U.S. Cl.
CPC ..... *A47L 15/505* (2013.01); *A47L 15/50* (2013.01); *A47L 15/503* (2013.01)

(58) Field of Classification Search
CPC ..... A47L 15/50; A47L 15/503; A47L 15/505
(Continued)

(56) References Cited

U.S. PATENT DOCUMENTS 2,213,918 A 9/1940 Lofstrand, Jr.
3,512,227 A 5/1970 Krawagna
(Continued)

FOREIGN PATENT DOCUMENTS

CN 201061516 Y 5/2008
CN 101977539 A 2/2011
(Continued)

OTHER PUBLICATIONS

Written Opinion for Application No. PCT/EP2012/076769 dated Feb. 11, 2013.
(Continued)

*Primary Examiner* — Michael Barr
*Assistant Examiner* — Levon J Shahinian
(74) *Attorney, Agent, or Firm* — Alston & Bird LLP

(57) ABSTRACT

The present invention relates to a stemware holder unit (1) for holding a stemware (23) in a predetermined position in a dishwasher cup shelf (13), said stemware holder unit (1) comprising a flexible holding element (2) adapted to hold a stem (22) of said stemware (23). The holding element (2) comprises a first attachment portion (3) and a second attachment portion (4) adapted to be movably interconnected with said dishwasher cup shelf (13). The stemware holder unit (1) has a loading state, in which said holding element (2) is adapted to receive said stem (22) of said stemware (23), and a secured state, in which said holding element (2) is adapted to secure said stem (22) of said stemware (23), and wherein, in said loading state, said holding element (2) is essentially unfolded, and in said secured state, said holding element (2) is folded and essentially enclosing said stem (22) of said stemware (23). The present invention further relates to a dishwasher cup shelf (13) comprising at least one stemware holder unit, and to a dishwasher basket assembly (16) comprising such a dishwasher cup shelf (13).

18 Claims, 4 Drawing Sheets

(58) Field of Classification Search
USPC ..... 134/56 D, 57 D, 58 D, 135, 153, 164, 134/166 R; 211/41.8, 41.9
See application file for complete search history.

(56) References Cited

U.S. PATENT DOCUMENTS

| | | | | |
|---|---|---|---|---|
| 3,752,322 | A | 8/1973 | Fiocca et al. | |
| 4,029,277 | A | 6/1977 | Bulanda | |
| 4,589,556 | A | 5/1986 | Peretz | |
| 4,909,401 | A | 3/1990 | McConnell | |
| 5,249,590 | A | 10/1993 | Jacobus et al. | |
| D342,005 | S | 12/1993 | Forsberg | |
| 5,277,387 | A | 1/1994 | Lewis et al. | |
| 5,572,776 | A | 11/1996 | Murphy et al. | |
| 6,123,204 | A | 9/2000 | Nelson et al. | |
| 6,394,285 | B1 | 5/2002 | Arthurs et al. | |
| 6,932,312 | B1 | 8/2005 | Chen | |
| D547,048 | S | 7/2007 | Conway et al. | |
| 7,458,471 | B2 | 12/2008 | Crudgington, Jr. | |
| 7,523,902 | B2 | 4/2009 | Almeida | |
| 7,543,712 | B2 | 6/2009 | Purushothaman | |
| 7,556,231 | B2 | 7/2009 | Herbst et al. | |
| D642,039 | S | 7/2011 | Forsberg et al. | |
| 7,988,107 | B2 | 8/2011 | Miller et al. | |
| 8,573,576 | B2 | 11/2013 | Clark et al. | |
| 2005/0236345 | A1* | 10/2005 | Herbst | A47L 15/505 211/41.9 |
| 2006/0138064 | A1 | 6/2006 | Crudgington | |
| 2007/0163626 | A1 | 7/2007 | Klein | |
| 2008/0149149 | A1 | 6/2008 | Ryu et al. | |
| 2008/0185352 | A1 | 8/2008 | O'Hara | |
| 2011/0192808 | A1 | 8/2011 | Buhl et al. | |
| 2011/0247990 | A1* | 10/2011 | Chai | A47L 15/503 211/150 |
| 2011/0290804 | A1 | 12/2011 | Kohles et al. | |
| 2012/0292273 | A1 | 11/2012 | McNamara | |

FOREIGN PATENT DOCUMENTS

| | | | |
|---|---|---|---|
| DE | 3022484 | A1 | 1/1982 |
| DE | 9216330 | U1 | 4/1994 |
| DE | 9407327 | U1 | 7/1994 |
| DE | 9421847 | U1 | 11/1996 |
| DE | 297 11 822 | | 10/1998 |
| DE | 297 20 069 | | 3/1999 |
| DE | 29720069 | U1 | 3/1999 |
| DE | 29902157 | U1 | 5/1999 |
| DE | 29822086 | U1 | 6/1999 |
| DE | 20005725 | U1 | 8/2000 |
| EP | 1 356 761 | A2 | 10/2003 |
| EP | 1 424 035 | A1 | 6/2004 |
| EP | 1 683 465 | A1 | 7/2006 |
| EP | 1 925 251 | A2 | 5/2008 |
| EP | 1 929 928 | A1 | 6/2008 |
| EP | 2 353 488 | | 8/2011 |
| FR | 2152375 | A1 | 4/1973 |
| GB | 1393054 | A | 5/1975 |
| GB | 2321394 | A | 7/1989 |
| WO | WO 2005/042212 | A1 | 5/2005 |
| WO | WO 2009/097139 | A2 | 8/2009 |
| WO | WO 2013/045543 | A1 | 4/2013 |

OTHER PUBLICATIONS

International Search Report for PCT/EP2012/076769; dated Feb. 4, 2013.
Office Action for Chinese Application No. 201280078146.7 dated Oct. 10, 2016.

* cited by examiner

STEMWARE HOLDER UNIT, DISHWASHER CUP SHELF COMPRISING A STEMWARE HOLDER UNIT, AND A DISHWASHER BASKET ASSEMBLY COMPRISING A DISHWASHER CUP SHELF

CROSS REFERENCE TO RELATED APPLICATIONS

This application is a national stage application filed under 35 U.S.C. 371 of International Application No. PCT/EP2012/076769, filed Dec. 21, 2012, which is incorporated by reference herein in its entirety.

FIELD OF THE INVENTION

The present invention relates to a stemware holder unit, a dishwasher cup shelf comprising such stemware holder unit, and a dishwasher basket assembly comprising such dishwasher cup shelf, according to the preambles of the independent claims.

BACKGROUND OF THE INVENTION

Dishwashers, and in particular dishwashers designed for domestic use, are oftentimes provided with sprayers accomplishing the washing and rinsing of glasses, cups, cutlery items and the like by spraying pressurized streams of water mixed with a detergent over the glassware and crockery ware. The stream of the water must have enough pressure to clean the items in the dishwasher thoroughly, and as a consequence, the stream may sometimes cause the items in the dishwasher to dislodge when the dishwasher is in use. Dislodging of the items in the dishwasher may also be a problem when pulling out or sliding in the racks from and into the dishwasher. In particular, stemware, e.g. wineglasses and the like, may tend to easily get dislodged from their position in the rack of the dishwasher.

Today on the market, there are a great variety of known racks and holding devices, designed in different ways for holding different items in position in the dishwasher. One example of a holding device for holding stemware is disclosed in DE 29711822 U1. The holding device is designed as a cup rack provided with a plurality of supporting elements adapted to support a number of wineglasses. The supporting elements are provided with flexible snap elements adapted to aid in keeping the wineglasses in position.

A potential problem with using snap elements for securing the position of the stem in the cup rack is that it may be difficult to arrange the stem in the appropriate position between the supporting elements, and to remove the stem, in particular if the snap elements are not flexible enough. The stem of the wineglass may be fragile, and thus, the snap elements must be flexible enough to make it easy to arrange the stem in position without risking breaking the stem, at the same time as the snap elements must keep the stem in the desired position, which may be difficult to accomplish at the same time. In addition, the thickness of the stem of wineglasses may be different on different wineglasses which may also be a potential problem. The distance between the snap elements must then preferably be adapted to the thickness of the stem.

In DE 92 16330 U1 another example of a holding device for keeping stemware in position in a dishwasher is disclosed. In a similar way as mentioned above, the holding device is designed as a cup rack, and provided with a plurality of supporting elements adapted to support a number of wineglasses.

Yet another example of a holding device for wineglasses is disclosed in DE 29822086 U1. The holding device comprises a U-shaped element adapted to support the stem of the wineglass.

In GB2321394 A a support element, adapted to be pivotably mounted on a side wall of a basket, is disclosed. The movable support elements comprises slot openings extending in a substantially longitudinal direction with respect to the elements. The slot openings are adapted to engage with pegs fixed to the basket.

Thus, a variety of holding devices have been suggested to hold stemware glasses or other unstable items in the appropriate position in the dishwasher while in use, or while sliding the rack out from or into the dishwasher. However, the inventors of the present invention have identified a need for an improved holding device, which keeps the stemware in position more accurately, which may hold stems of different thickness, and which facilitates securing the stemware in the holding device.

An object of the present invention is to provide a holding device for stemware which ensures upright and secure position of the stemware within the rack of the dishwasher.

A further object of the present invention is to provide a holding device for stemware which facilitates positioning of the stemware in the holding device and removal of the stemware from the holding device.

Another object of the present invention is to provide a holding device which may hold stems of different thickness in position.

SUMMARY OF THE INVENTION

The above-mentioned objects are achieved by the present invention according to the independent claim.

Preferred embodiments are set forth in the dependent claims.

The stemware holder unit, for holding a stemware in a predetermined position in a dishwasher cup shelf, in accordance with the present invention, comprises a flexible holding element adapted to hold a stem of said stemware. The flexible holding element comprises a first attachment portion and a second attachment portion adapted to be movably interconnected with said dishwasher cup shelf. The stemware holder unit has a loading state, in which said holding element is adapted to receive said stem of said stemware, and a secured state, in which said holding element is adapted to secure said stem of said stemware, and wherein, in said loading state, said holding element is essentially unfolded, and in said secured state, said holding element is folded and essentially encloses said stem of said stemware.

According to another aspect, the present invention relates to a dishwasher cup shelf comprising a stemware holder unit.

According to yet another aspect, the present invention relates to a dishwasher basket assembly comprising a dishwasher cup shelf.

SHORT DESCRIPTION OF THE APPENDED DRAWINGS

Figure 6A:
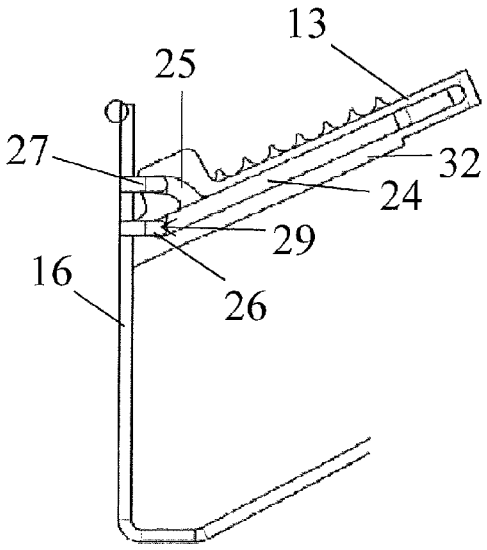

FIG. 6*a* shows a dishwasher cup shelf which is foldably and slidingly attached to a dishwasher basket assembly, said dishwasher cup shelf being in a lowered position, according to one embodiment of the present invention.

Figure 6B:
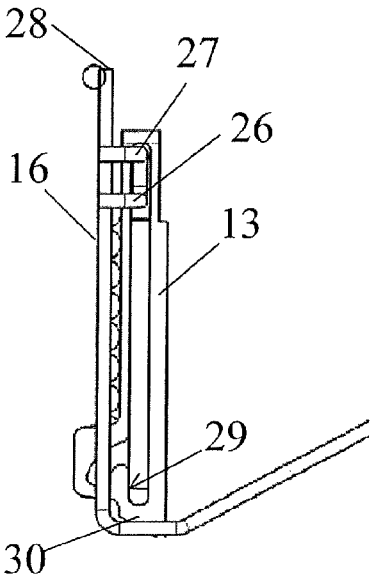

FIG. 6*b* shows a dishwasher cup shelf which is foldably and slidingly attached to a dishwasher basket assembly, when in a folded up position, according to one embodiment of the present invention.

Figure 7:
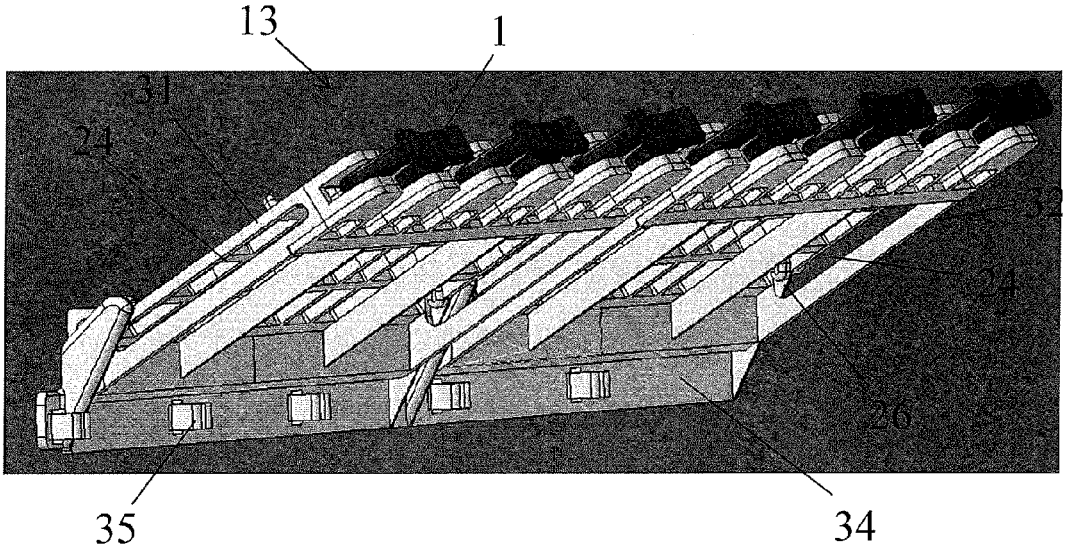

FIG. 7 shows a dishwasher cup shelf which is foldably and slidingly attached to a dishwasher basket assembly, according to another embodiment of the present invention.

DETAILED DESCRIPTION OF PREFERRED EMBODIMENTS OF THE INVENTION

Figure 1:
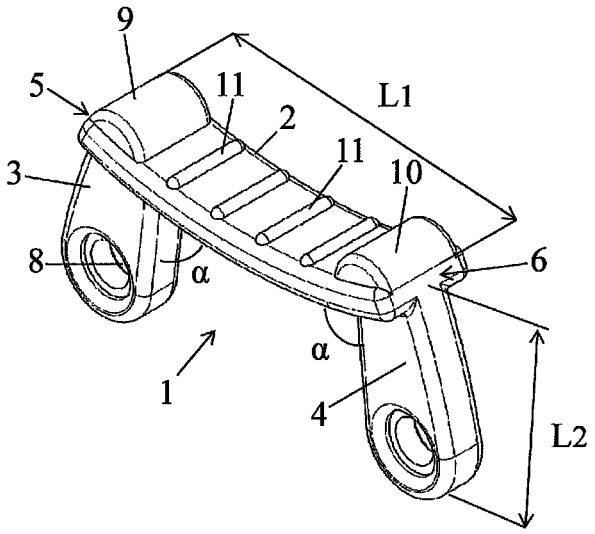
FIG. 1 shows a stemware holder unit, when in the loading state, according to one embodiment of the present invention.
Figure 2:
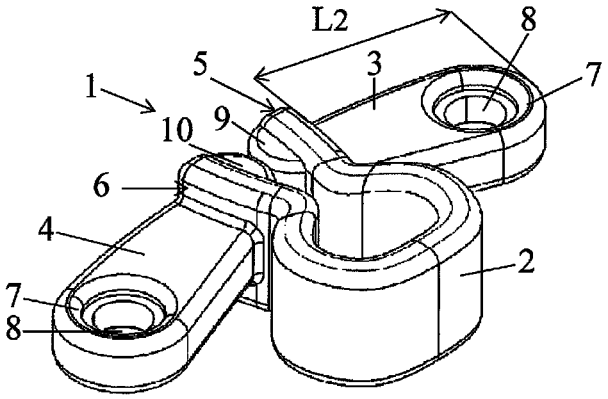
FIG. 2 shows a stemware holder unit, when in the secured state, according to one embodiment of the present invention.

FIG. 1 shows a stemware holder unit 1 for holding a stemware 23 in a predetermined position in a dishwasher cup shelf 13, according to one embodiment of the present invention. The stemware holder unit 1 comprises a flexible holding element 2 adapted to hold a stem 22 of the stemware 23. The holding element 2 comprises a first attachment portion 3 and a second attachment portion 4 adapted to be movably interconnected with the dishwasher cup shelf. The stemware holder unit 1 has a loading state, as shown in FIG. 1, wherein the holding element 1 is adapted to receive the stem 22 of the stemware 23, and a secured state, as illustrated in FIG. 2, wherein the holding element 2 is adapted to secure the stem 22 of the stemware 23. In the loading state, the holding element 2 is essentially unfolded, and extended along its length $L_1$.

In use, the stem 22 of the stemware 23 is placed against the holding element 2 which is unfolded, or essentially unfolded, in said loading state. The stem 22 is then pushed against the holding element 2, in the direction of the dishwasher cup shelf, wherein the holding element 2 becomes folded and eventually essentially encloses the stem of the stemware, when in the secured state. The loading state and the secured state are substantially stable states, wherein, when the stemware holder unit 1 has been brought to the secured state by the user, by applying a force in the direction of the cup shelf, the stemware holder unit 1 will remain in the secured state until the user applies a force in the opposite direction.

According to one embodiment, as further shown in FIG. 1, the first attachment portion 3 is attached essentially at a first end 5 of the holding element 2 and the second attachment portion 4 is attached essentially at a second opposite end 6 of the holding element 2.

In one embodiment, the holding element 2 comprises a plurality of ribs 11 arranged at the opposite side of the holding element 2 with respect to the first and second attachment portions 3, 4. Advantageously, the ribs 11 aids in keeping the stem 22 in the predetermined position, when in the secured state, and the ribs 11 also aids in keeping the stem 22 in position when the stem 22 is placed against the holding element 2, when in the loading state.

In one embodiment, the first attachment portion 3 and the second attachment portion 4 are rigidly attached to the holding element 2. The attachment portions 3, 4 being rigidly attached to the holding element 2 is advantageous in that it facilitates folding the holding element 2.

According to one embodiment, as further illustrated in FIG. 1, the first attachment portion 3 and the second attachment portion 4, respectively, extends in an angle $\alpha$ which is essentially 90° with respect to the holding element 2. However, the angle $\alpha$ may be approximately 80°-110°.

In one embodiment, the holding element 2 has a length $L_1$, and the first attachment portion 3 and the second attachment portion 4 respectively has a length $L_2$, and wherein the length $L_2$ is less than half of the length $L_1$. Thereby, the first attachment portion 3 and the second attachment portion 4 may be rotated essentially 90°, with respect to a pivot point at a first supporting portion 14 and a pivot point at a second supporting portion 15 of the dishwasher cup shelf 13, in the direction towards each other, such that the first end 5 and the second end 6 are directed towards each other (see FIG. 2) wherein the holding element 2 forms a loop adapted to enclose the stem 22 of the stemware 23. Preferably, the length $L_1$ of the holding element 2 is approximately between 25-50 mm, and more preferably between 32-38 mm, and the length $L_2$ is approximately between 10-30 mm, and more preferably between 14-17 mm.

FIG. 2, shows the stemware holder unit 1, according to one embodiment of the present invention, when in the secured state. As illustrated in FIG. 2, the holding element 2 is folded and is adapted to essentially enclose the stem 22 of the stemware 23. The first attachment portion 3 and the second attachment portion 4, respectively, comprises a pivot connection element 7, adapted to interact with a cup shelf pivot connection element 17 of the dishwasher cup shelf 13.

In the embodiment shown in FIG. 2, the pivot connection element 7 in the holder unit 1 is a hole 8, and the cup shelf pivot connection element 17 in the cup shelf 13 is a pin. However, as an obvious constructional variation, the pivot connection element 7 in the holder unit 1 may be a pin, and the cup shelf pivot connection element 17 in the cup shelf 13 may be a hole.

According to one embodiment, the holding element 2 is provided with a first protrusion 9 and a second protrusion 10, the first protrusion 9 being arranged essentially at the first end 5 of the holding element 2 and the second protrusion 10 being arranged at the second end 6 of the holding element 2. The protrusions 9,10 are arranged at the opposite side of the holding element 2 with respect to the first and second attachment portions 3, 4.

In one embodiment, as illustrated in FIG. 2, the protrusions 9, 10 are adapted to abut against each other, in the secured state. Advantageously, the protrusions 9, 10 being in abutment ensures that the stem 22 is accurately secured and completely enclosed by the holding element 2.

As mentioned above, the holding element 2 of the stemware holder unit 1 is made from a flexible material. The holding element 2 may, e.g. be made from rubber, or a flexible plastic material, or any other suitable flexible material.

Figure 3:
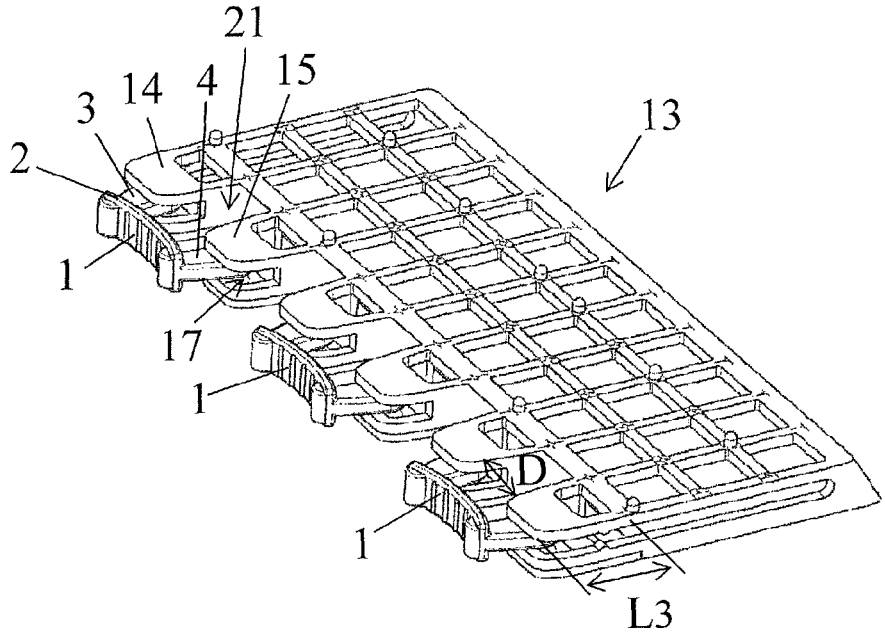
FIG. 3 shows a dishwasher cup shelf comprising a plurality of stemware holder units, according to one embodiment of the present invention.

In another aspect, as illustrated in FIG. 3, the present invention relates to a dishwasher cup shelf 13 comprising at least one stemware holder unit 1. Such a dishwasher cup shelf 13 is preferably attached to a dishwasher basket assembly 16, and the cup shelf 13 provides an extra space for stacking cups in the dishwasher. The dishwasher cup shelf 13 comprises at least a first supporting portion 14 and a second supporting portion 15, wherein a space 21 is provided between the first supporting portion 14 and the second supporting portion 15. The length $L_3$ of the first and second supporting portions 14, 15 is preferably 10-40 mm, and more preferably 16-18 mm, and the first and second supporting portions 14, 15 are preferably arranged at a distance D from each other. The distance D is preferably between 25-50 mm, and more preferably between 14-17 mm. The cup shelf 13 is preferably made from any hard plastic, such as Polypropylene (PP), however, the cup shelf 13 may be made from any other suitable hard material such as metal.

In the embodiment shown in FIG. 3, the first attachment portion 3 of the stemware holder unit 1 is pivotally interconnected with the first supporting portion 14 of the cup shelf 13, and the second attachment portion 4 of the stemware holder unit 1 is pivotally interconnected with the second supporting portion 15 of the cup shelf 13, such that, in the secured state, the holding element 2, which is adapted to essentially enclose the stem 22 of the stemware 23 in the secured state, is essentially arranged in the space 21.

In the embodiment shown in FIG. 3, the dishwasher cup shelf 13 is provided with three stemware holder units 1. However, the dishwasher cup shelf 13 may be provided with any number of holder units 1, but preferably the number of holder units 1 is between 1-20, and more preferably between 6-18.

According to one embodiment, each one of the first supporting portion 14 and the second supporting portion 15 are provided with a cup shelf pivot connection element 17, wherein each cup shelf pivot connection element 17 is interconnected with a pivot connection element 7 of the stemware holder unit 1.

Figure 4:
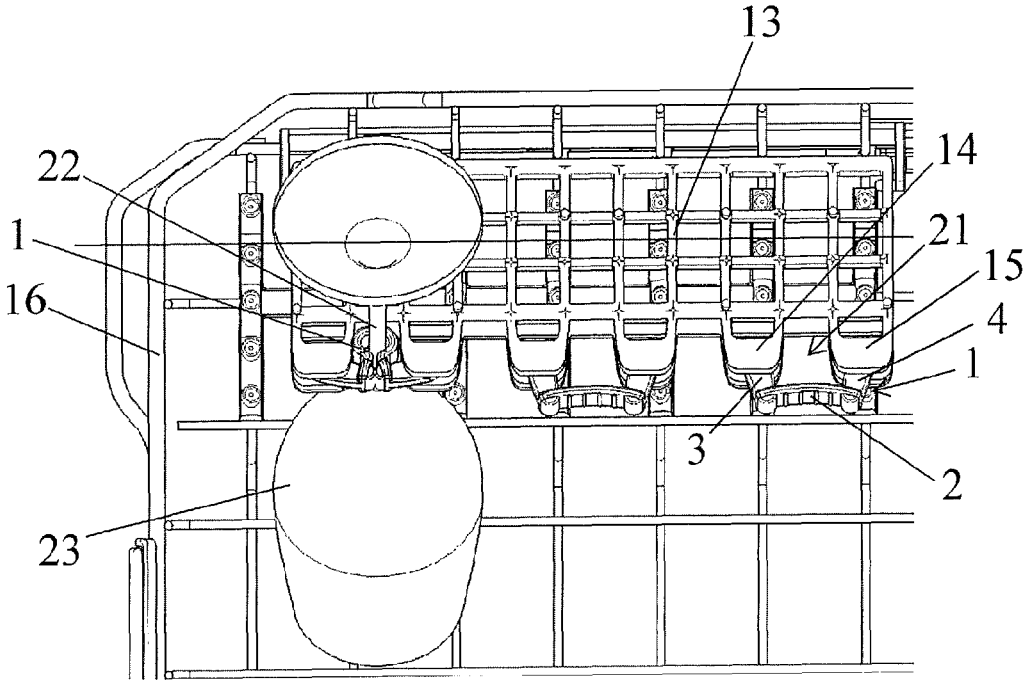
FIG. 4 shows a dishwasher cup shelf comprising a plurality of stemware holder units, the dishwasher cup shelf being mounted in a dishwasher basket assembly, according to one embodiment of the present invention.

FIG. 4 shows the dishwasher cup shelf 13 when in use, according to one embodiment of the present invention. The dishwasher cup shelf 13 is provided with three stemware holder units 1, whereof one of the stemware holder units 1 is in the secured state, and the other two are in the loading state. The stemware holder unit 1 which is in the secured state encloses a stem 22 of a stemware 23, such that the stemware 23 is kept in a predetermined position. Advantageously, the stemware holder unit 1 encloses the stem 22, when in the secured state, and thereby prevents the stemware 23 from moving out of position. As seen in FIG. 4 a space 21 is provided between the first supporting portion 14 and the second supporting portion 15, and when in the secured state, when the holding element 2 is folded and encloses the stem 22, the stemware holder unit 1 is essentially arranged in the space 21. FIG. 4, further shows that the protrusions 9, 10 are in abutment with each other, when in the secured state. The dishwasher cup shelf 13 is attached to the dishwasher basket assembly 16.

According to one embodiment, one or more stemware holder units 1 may be attached to a dishwasher basket assembly 16. The dishwasher basket assembly 16 then comprises the at least first supporting portion 14 and second supporting portion 15 and a space 21 is provided in between the first supporting portion 14 and the second supporting portion 15.

Figure 5:
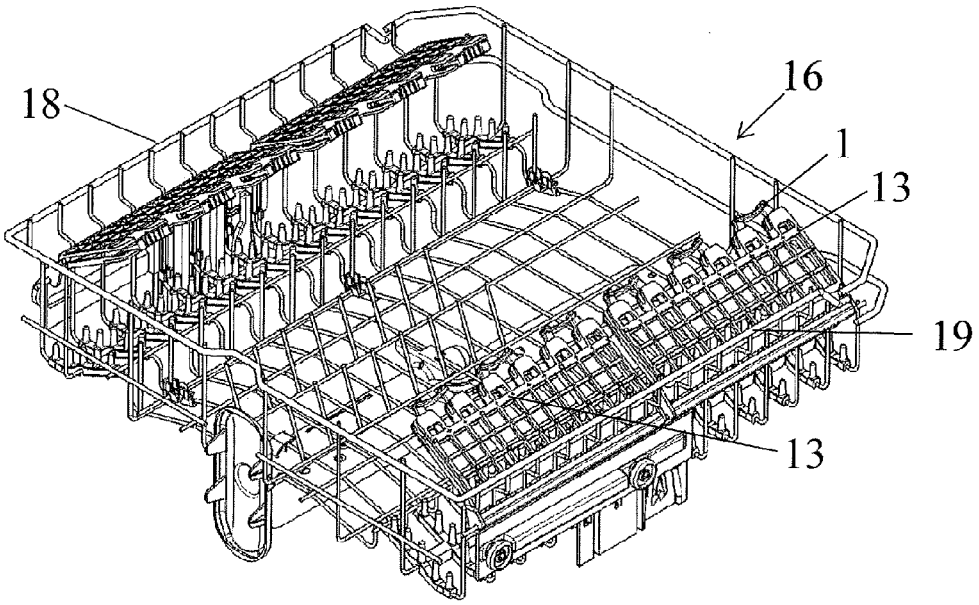
FIG. 5 shows a plurality of dishwasher cup shelves comprising a plurality of stemware holder units, the dishwasher cup shelves are mounted in a dishwasher basket assembly, according to one embodiment of the present invention.

According to one embodiment, as illustrated in FIG. 5, at least one dishwasher cup shelf 13 is adapted to be foldably attached to a dishwasher basket assembly 16. In the embodiment shown in FIG. 5, the dishwasher basket assembly 16 is provided with two dishwasher cup shelves 13 arranged at a first side 18 of said dishwasher basket assembly 16 and two dishwasher cup shelves 13 arranged at a second 19 side of said dishwasher basket assembly 16, each one comprising three stemware holder units 1. However, the dishwasher basket assembly 16 may instead be provided with one or more dishwasher cup shelves 13 extending the complete length of the dishwasher basket assembly 16. The cup shelves 13 may be arranged in a lower rack in the dishwasher, which is advantageous in that the lower rack provides more space for bigger wine glasses. However, naturally the cup shelves 13 may be arranged in an upper rack in the dishwasher, or there may be cup shelves 13 arranged in both the upper and lower racks.

In one embodiment, as illustrates in FIGS. 6*a* and 6*b*, the dishwasher cup shelf 13 comprises a plurality of sliding grooves 24, 25, respectively adapted to receive at least one sliding element 26, 27 attached to the dishwasher basket assembly 16. The sliding function is advantageous in that it provides a more space efficient mounting of the dishwasher cup shelf 13 to the dishwasher basket assembly 16, e.g. when the dishwasher cup shelf 13 is in the folded up position it leaves more space above the dishwasher basket assembly 16 since the dishwasher cup shelf 13 does not extend above the upper edge 28 of the dishwasher basket assembly 16. In the embodiment shown in FIG. 6*b*, the dishwasher cup shelf 13 is in a folded up position.

In FIG. 6*a*, when the dishwasher cup shelf 13 is in the lowered position, the upper sliding element 27 is arranged in an upper sliding groove 25, and the lower sliding element 26 is arranged in a lower sliding groove 24. The upper sliding groove 25 is preferably arc-shaped. When folding up or lowering the cup shelf 13, a rear end 29 of the lower sliding groove 24, acts as a pivot point. The upper sliding groove 25 in co-operation with the upper sliding element 27 advantageously maintains the dishwasher cup shelf 13 in a predetermined angular position, with respect to the dishwasher basket assembly 16, when the dishwasher cup shelf 13 is in the lowered position.

As further illustrated in FIGS. 6*a* and 6*b*, the cup shelf 13 comprises a rear side 30, adapted to be arranged to extend along a portion of an inner side 18, 19 of the dishwasher basket assembly 16, and an opposite front side comprising the at least first supporting portion 14 and the second supporting portion 15. The cup shelf 13 further comprises a first short side 31 (not shown in FIGS. 6*a* and 6*b*) and a second short side 32, each short side 31, 32 being provided with the at least one elongated sliding groove 24, 25 extending along the short side 31, 32 of the cup shelf 13. Furthermore, each sliding groove 24, 25 is adapted to receive the at least one sliding element 26, 27 of the dishwasher basket assembly 16. The cup shelf 13 is thereby slidingly foldable between a lowered position and an essentially vertical position.

In another embodiment, as illustrated in FIG. 7, the dishwasher cup shelf 13 comprises one sliding grooves 24 adapted to receive one sliding element 26. One sliding groove 24 is arranged at a first short side 31 and one is arranged at a second short side 32. The sliding element(s) 26 are mounted in a mounting frame 34. The mounting frame 34 comprises a plurality of fastening elements 35 adapted to be attached to a dishwasher basket assembly 16. Preferably, the fastening elements 35 are detachably fastened to the dishwasher basket assembly 16. This provides for more flexibility for the user.

In another aspect, the present invention relates to a dishwasher comprising at least one dishwasher basket assembly 16 comprising at least one dishwasher cup shelf 13.

The present invention is not limited to the above-described preferred embodiments. Various alternatives, modifications and equivalents may be used. Therefore, the above embodiments should not be taken as limiting the scope of the invention, which is defined by the appending claims.

The invention claimed is:

1. A stemware holder unit for holding a stemware in a predetermined position in a dishwasher cup shelf, said stemware holder unit comprising a flexible holding element adapted to hold a stem of said stemware, said holding element comprising a first attachment portion and a second attachment portion adapted to be movably interconnected with said dishwasher cup shelf, wherein said stemware holder unit has a loading state, in which said holding element is adapted to receive said stem of said stemware, and a secured state, in which said holding element is adapted to secure said stem of said stemware, wherein, in said loading state, said holding element is essentially unfolded, and in said secured state, said holding element is folded and essentially encloses said stem of said stemware, and wherein the holding element is configured to fold between the loading state and the secured state.

2. The stemware holder unit according to claim 1, wherein said first attachment portion is attached essentially at a first end of said holding element and said second attachment portion is attached essentially at a second opposite end of said holding element.

3. The stemware holder unit according to claim 2, wherein said holding element is provided with a first protrusion and a second protrusion, said first protrusion being arranged essentially at said first end of said holding element and said second protrusion being arranged at said second end of said holding element, and said protrusions being arranged at an opposite side of said holding element with respect to said first and second attachment portions.

4. The stemware holder unit according to claim 3, wherein, in said secured state, said protrusions are adapted to abut against each other.

5. The stemware holder unit according to claim 1, wherein said first attachment portion and said second attachment portion are rigidly attached to said holding element.

6. The stemware holder unit according to claim 1, wherein said first and second attachment portions, respectively, extends in an angle which is essentially 90° with respect to said holding element.

7. The stemware holder unit according to claim 1, wherein said holding element has a length $L_1$, and said first attachment portion and said second attachment portion respectively has a length $L_2$, and wherein said length $L_2$ is less than half of said length $L_1$.

8. The stemware holder unit according to claim 7, wherein said length $L_1$ of said holding element is approximately between 32-38 mm.

9. The stemware holder unit according to claim 7, wherein said length $L_2$ of said first and second attachment portion is approximately between 14-17 mm.

10. The stemware holder unit according to claim 1, wherein said first attachment portion and said second attachment portion, respectively, comprises a pivot connection element, adapted to interact with a cup shelf pivot connection element of said dishwasher cup shelf.

11. The stemware holder unit according to claim 1, wherein said holding element comprises a plurality of ribs arranged at the opposite side of the holding element with respect to said first and second attachment portions.

12. A dishwasher cup shelf comprising at least one stemware holder unit according to claim 1, said dishwasher cup shelf comprising at least a first supporting portion and a second supporting portion, wherein a space is provided between said first supporting portion and said second supporting portion, wherein said first attachment portion of said stemware holder unit is pivotally interconnected with said first supporting portion, and that said second attachment portion of said stemware holder unit is pivotally interconnected with said second supporting portion, such that, in said secured state, said holding element, which is adapted to essentially enclose said stem of said stemware in said secured state, is essentially arranged in said space.

13. The dishwasher cup shelf according to claim 12, wherein each one of said first supporting portion and said second supporting portion are provided with a cup shelf pivot connection element, wherein each cup shelf pivot connection element is interconnected with a pivot connection element of said stemware holder unit.

14. The dishwasher cup shelf according to claim 12, wherein said dishwasher cup shelf is adapted to be foldably attached to a dishwasher basket assembly, and wherein said dishwasher cup shelf comprises a plurality of sliding grooves, respectively adapted to receive a sliding element attached to said dishwasher basket assembly.

15. A dishwasher basket assembly comprising the dishwasher cup shelf according to claim 12.

16. A dishwasher comprising the dishwasher basket assembly according to claim 15.

17. A stemware holder unit for holding a stemware in a predetermined position in a dishwasher cup shelf, said stemware holder unit comprising a flexible holding element adapted to hold a stem of said stemware, said holding element comprising a first attachment portion and a second attachment portion adapted to be movably interconnected with said dishwasher cup shelf, wherein the first attachment portion is movably interconnected to the dishwasher cup shelf at a first position, and the second attachment portion is movably interconnected to the dishwasher cup shelf at a second position different than the first position, wherein said stemware holder unit has a loading state, in which said holding element is adapted to receive said stem of said stemware, and a secured state, in which said holding element is adapted to secure said stem of said stemware, and wherein, in said loading state, said holding element is essentially unfolded, and in said secured state, said holding element is folded and essentially encloses said stem of said stemware.

18. The stemware holder unit according to claim 17, wherein the holding element is configured to fold between the loading state and the secured state.

* * * * *